US005636390A

United States Patent [19]

Strech

[11] Patent Number: 5,636,390

[45] Date of Patent: Jun. 10, 1997

[54] SINK STOPPER FOR CLEANING AND STUFFING

[76] Inventor: Kenneth R. Strech, 2598 Mt. View Ave., San Bernadino, Calif. 92405

[21] Appl. No.: 546,319

[22] Filed: Oct. 20, 1995

[51] Int. Cl.[6] ..... A47K 1/14

[52] U.S. Cl. ..... 4/295; 4/286

[58] Field of Search ..... 4/295, 287, 288, 4/289, 290, 291, 292, 293, 294; 241/168, 273.3, 273.4; 7/116; 115/105, 111, 118

[56] References Cited

U.S. PATENT DOCUMENTS

| | | | |
|---|---|---|---|
| 2,075,443 | 3/1987 | Kirschner et al. | 4/287 |
| 2,643,394 | 6/1953 | Wood | 4/287 |
| 3,427,636 | 2/1969 | Seifert | 15/105 |
| 3,609,776 | 10/1971 | Haldopoulos et al. | 4/295 |
| 4,137,578 | 2/1979 | Felici | 4/255 |
| 4,268,080 | 5/1981 | Lindley | 294/1 |
| 4,409,692 | 10/1983 | Ness | 4/286 |
| 4,504,996 | 3/1985 | Loos | 15/105 |
| 4,745,642 | 5/1988 | Shands . | |
| 5,377,362 | 1/1995 | Jackson | 4/292 |
| 5,404,596 | 4/1995 | Coory | 4/287 |
| 5,473,782 | 12/1995 | Coakley | 15/105 |

*Primary Examiner*—David J. Walczak
*Attorney, Agent, or Firm*—Gene Scott, Patent Law & Venture Group

[57] ABSTRACT

A combination sink stoppering, surface scrubbing, garbage scooping, garbage stuffing device having a generally horizontally oriented disk-shaped body providing a downfacing surface flange for stoppering a drain of a garbage disposal device. A curved scooper extends vertically downwardly from the body, the scooper providing a curved edge designed to contact a sink surface and scoop garbage from the surface into the scooper. When the garbage collected in the scooper, the scooper is positionable vertically within the drain of the disposal so as to cleanly push the garbage into the disposal comminuting chamber.

9 Claims, 3 Drawing Sheets

SINK STOPPER FOR CLEANING AND STUFFING

BACKGROUND OF THE INVENTION

1. Field of the Invention

This invention relates generally to sink cleaning and stoppering devices, and more particularly to an improved, single device that effectively scrapes garbage from a sink surface, pushes it into a garbage disposal, and stops the drain.

2. Description of Related Art

Over the past several decades, the installation and use of garbage disposal devices has dramatically risen. While these devices provide numerous advantages not attainable by standard sink and drain configurations, they also present numerous additional problems. Most notably, small items such as silverware frequently inadvertently fall into the comminuting chamber of the disposal. If such items are not retrieved before the disposal is activated, the blades of the disposal may be damaged or destroyed. Thus, invention and use of stoppering devices designed to block the entrance to the garbage disposal are known to the public, as such devices prevent items from inadvertently falling into the disposal. Another significant problem associated with use of garbage disposal devices is that all garbage in the sink must be manually pushed across the sink's surface to the garbage disposal entrance. This forces the user to either dirty their hands to complete the task or else use an item, such as silverware, to scrape the garbage across the sink surface. However, the use of such items may scrape or damage the sink's surface. Thus, invention and use of specialized garbage scooping devices are known to the public, as such devices are used to gather garbage scattered across the sink's surface into a single pile. Yet another problem is incurred in trying to push garbage through the protective rubber fingers that frequently block the entrance to the comminuting chamber. Again, knives, forks and the like are often used to complete this task despite the fact that they may fall into the chamber and potentially damage the disposal. For a user to effectively eliminate all of these problems, a stopping, a scooping and a stuffing device are all necessary items. However, it is often inconvenient to store three separate items in the small area surrounding a sink. Thus, there is a clear need for an improved single device that is capable of scraping garbage from a sink surface, stuffing the garbage into the disposal and stoppering the disposal entrance.

Shands U.S. Pat. No. 4,745,642 teaches a sink stopper having a stopper flange body, handle and lower protruding element for pushing refuse into the garbage disposal comminuting chamber. Felici U.S. Pat. No. 4,137,578 also discloses a device for corralling refuse in a sink and forcing it through the drain opening into the garbage disposal. This device employs a bellows to bias a pushing element as it is forced into the opening of the comminuting chamber.

While both Shands and Felici are useful in pushing debris across the sink surface, neither of them are capable of effectively scraping garbage off the sink surface and stuffing it through the protective fingers and into the garbage disposal.

Loos U.S. 4,504,996 and Ness U.S. 4,409,692 are similar in design to Shands, these two devices including a scraper member rather than a push element. However, these devices also cannot be used to force the rubber fingers downwardly to discharge garbage into the comminuting chamber.

Lindley U.S. 4,268,080 discloses a manual tool used to push debris across the sink surface toward the disposal and then stuff the debris into the disposal. The device has a shape that prevents it from being inserted too far into the grinder disposal. Seifert U.S. Pat. No. 3,427,636 teaches a hand tool having scraper elements and a blunt end for pushing debris. However, as disclosed, both of these devices are intended only to feed refuse into the garbage disposal, and cannot be utilized to stop the drain and prevent silverware and other such items from inadvertently falling into the disposal. The present invention fulfills all three of these needs and provides further related advantages as described in the following summary.

SUMMARY OF THE INVENTION

The present invention is a combination surface scrubber, garbage stuffer and sink stopper particularly designed for use in conjunction with a sink having a garbage disposal device. The present invention is similar in construction to standard sink stoppers in that it has a disk shape and size appropriate for fitting closely within an entrance to standard garbage disposal devices so as to completely seal the entrance shut when desired. A tube-like scooping portion extends downwardly from the stopper portion, and a handle preferably extends upwardly from the stopper portion so that the device can be easily grasped and manipulated with the fingers of one hand. To scrape debris from the sink surface toward the drain, the device is simply positioned so that the edge of the scooping portion is in contact with the sink surface. As the device is slid across the sink surface, debris is collected in the scooper. The scooper is then inserted into the disposal, thus depositing the debris cleanly into the garbage disposal comminuting chamber. Thus, it is a primary object of the present invention to provide a device that is at once capable of scooping debris from the surface of a sink, pushing the debris into the garbage disposal and stopping the drain as needed. This is a significant advantage over prior art devices, none of which are capable of performing all three of these tasks, as it is significantly less expensive than purchasing three separate devices to perform the necessary functions.

Preferably, a scrubbing pad is positioned on the surface of the scooper. This pad can be brought into contact with the sink surface during scooping or any time scrubbing is required, and since a portion of the device fits within the drain opening it is particularly useful in scrubbing the interior of the drain opening. This allows the device to scrub the sink surface clean while simultaneously scraping debris from it. Likewise, a scrubbing brush may be included along the edge of the scooper, or even over the entire out facing surface of the scooper. Thus it is an object of the present invention to provide a device capable of more effectively scraping the sink surface by scrubbing it immediately after debris has been scraped from it.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a device for sink stoppering, surface scrubbing and garbage stuffing. In such drawings.

DETAILED DESCRIPTION OF THE PREFERRED EMBODIMENT

The above described drawing figures illustrate a device for scraping and scrubbing a sink surface (not shown), stuffing garbage through a drain of the sink (not shown) and stoppering the entrance to a comminuting chamber of the disposal (not shown). The device has a generally horizontally oriented disk-shaped body 10 that may be constructed of a structural material such as aluminum, stainless steel or the like, but is preferably made of plastic or hard rubber. The body is of a shape and size appropriate for fitting tightly within the drain. A horizontally oriented wall 17 extends across the body 15, the wall 17 positioned to prevent all liquids and solids from passing through the device and into the comminuting chamber when the device is positioned within the drain. In an alternate embodiment, the wall 17 includes at least one straining hole (not shown) so as to allow liquids to enter the drain while still preventing solid objects from passing through the drain and into the comminuting chamber. In yet another alternate embodiment, the wall 17 might include a valve of a common, well known type used in commercially available drain stoppers. In such a valve, a valve stem is usually manually rotatable into either one of two positions. In a first of the two alternate positions, the valve is able to be closed, and in a second of the two alternate positions, the valve is open in order to allow water to pass through.

Figure 2:
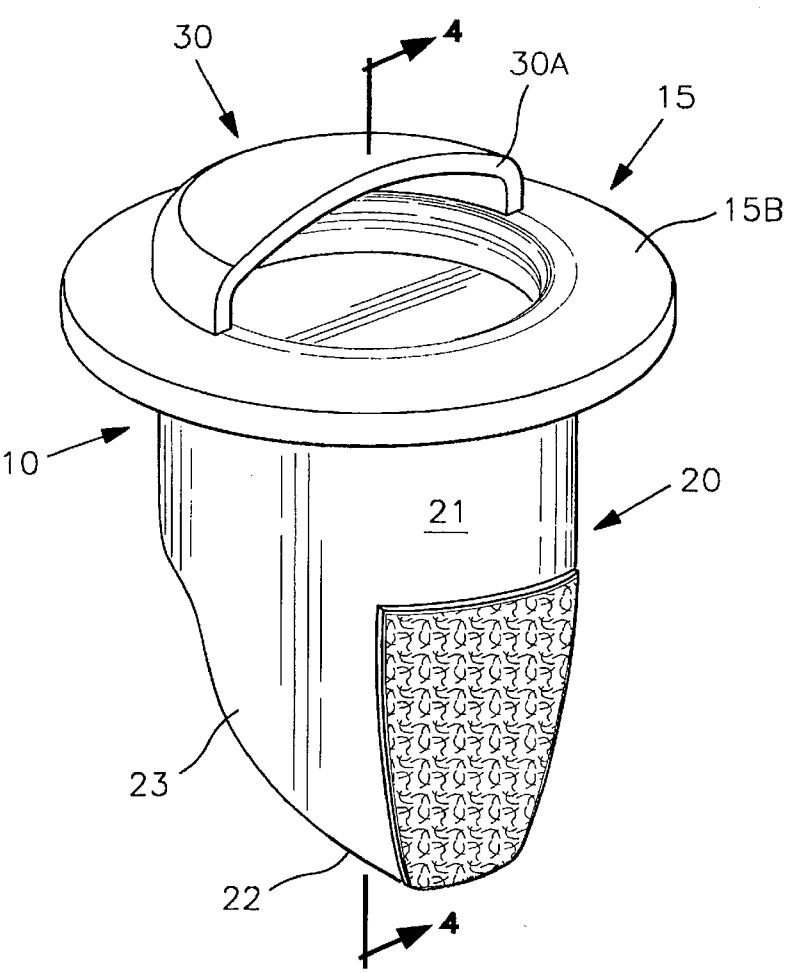
FIG. 2 is a perspective view of a second preferred embodiment of the present invention, particularly showing a raised handle.
Figure 1:
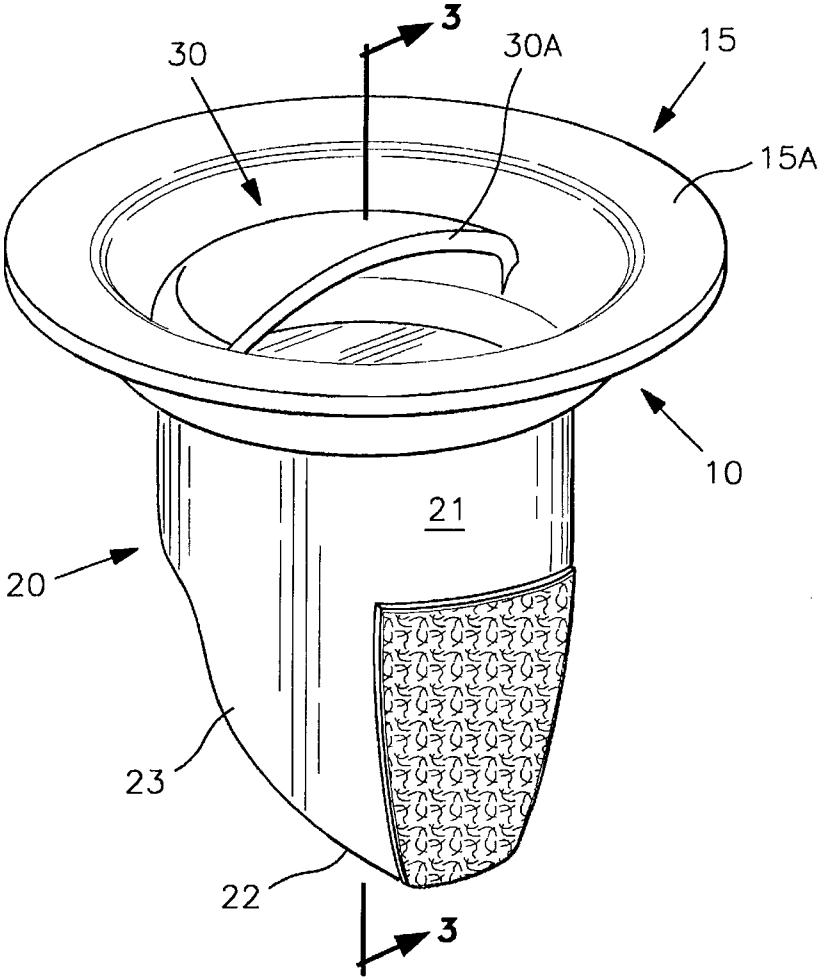
FIG. 1 is a perspective view of a first preferred embodiment of the present invention, particularly showing a recessed handle.
Figure 3:
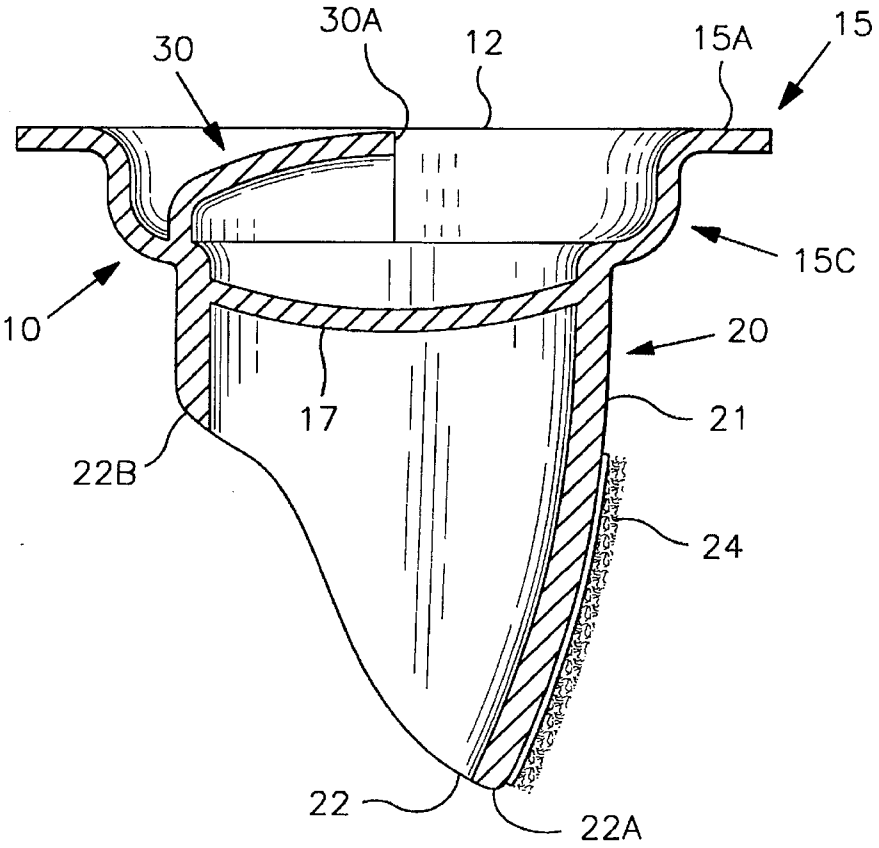
FIG. 3 is a cross-sectional view thereof taken along line 3—3 of FIG. 1, particularly showing further details of construction.

The body has an annular, down facing surface sealing means 15 for sealing the drain. There are numerous possible embodiments of the surface sealing means 15 well known in the art that may be successfully implemented within the present inventive configuration. In one preferred embodiment, illustrated in FIGS. 1, 3, and 5, the surface sealing means 15 includes a flat flange 15A which is strengthened by an annular wall 15C having an S-shaped cross-section, as best seen in FIG. 3, and in another preferred embodiment, illustrated in FIGS. 2, 4 and 6, the surface sealing means includes a downwardly protruding stiffening rim 15B.

Figure 4:
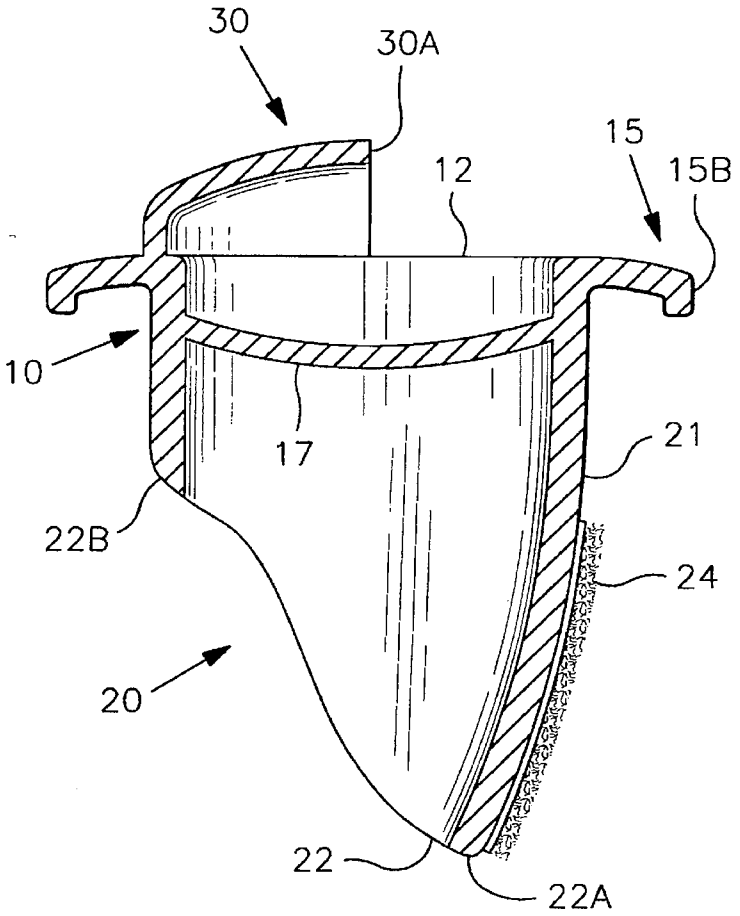
FIG. 4 is a cross-sectional view thereof taken along line 4—4 of FIG. 2, particularly showing further details of construction.
Figure 6:
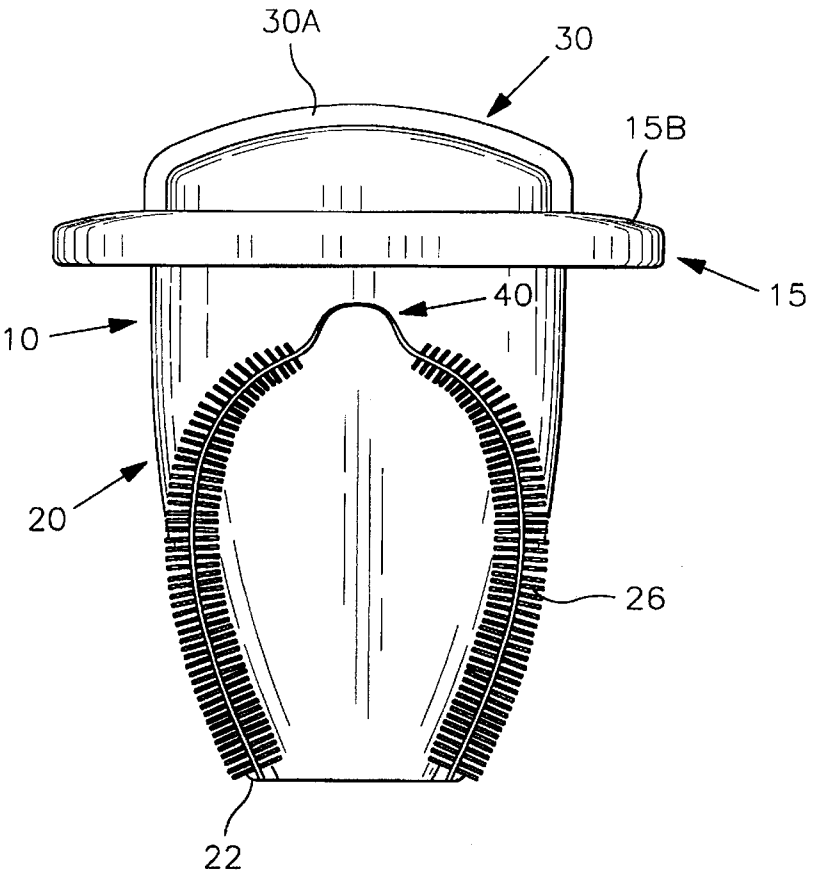
FIG. 6 is an elevational view of the invention of FIG. 2, particularly showing the placement of a brush means and a thumb accommodating means along a curved external edge of a scooping means of the invention.
Figure 5:
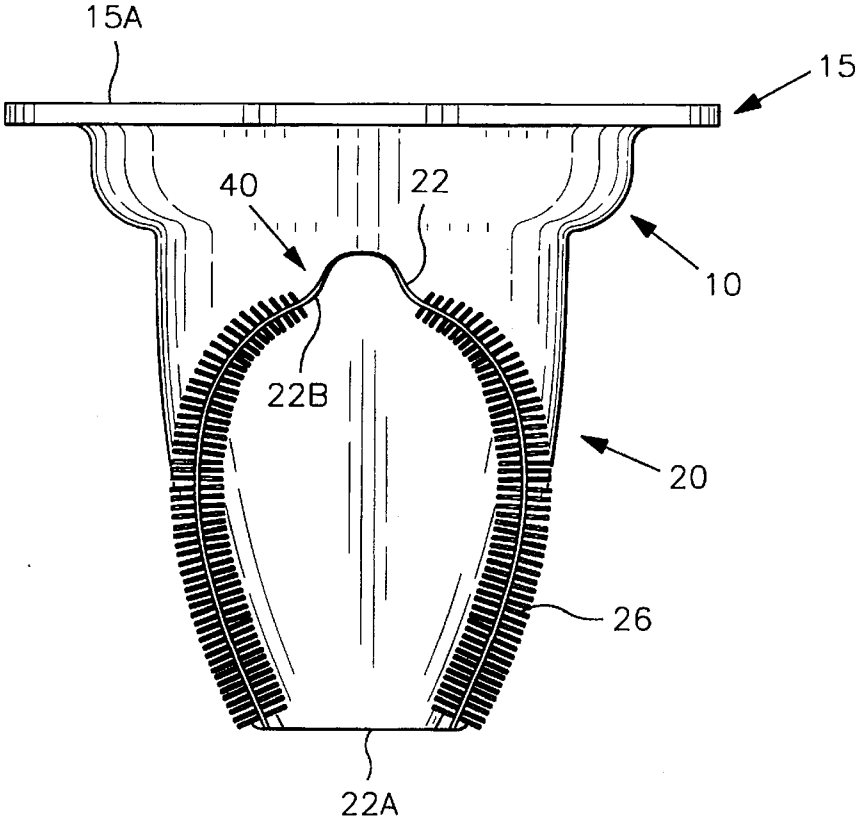
FIG. 5 is an elevational view of the invention of FIG. 1, particularly showing the placement of a brush means and a thumb accommodating means along a curved external edge of a scooping means of the invention.

A curved garbage means 20 extends y from the surface sealing means 15 in such a way as to be completely surrounded by the surface sealing means 15, as seen in the figures. The diameter of the garbage scooping means 20 is small enough so as to allow it to be easily positioned within the drain. The scooping means 20 has a cylinder-like sidewall 23 providing an outfacing surface 21 and terminates with a curved edge 22 having one portion 22A of the curved edge 22, extending further from the sealing means 15, than an opposing portion 22B of the curved edge 22. Both the outfacing surface 21 and the curved edge 22 are manipulable for bringing them in contact with the sink surface requiring scrubbing. Preferably, a scrubbing surface 24, such as the type found on a scouring pad or the like, is engaged on the outfacing surface 21, as clearly illustrated in FIGS. 1–4, so that when the device is moved across the sink surface to scoop garbage from it, the scrubbing surface 24 contacts the sink surface, thus simultaneously scooping garbage from the sink and scrubbing the sink surface clean. Additionally, to further aid in the effective scrubbing of the sink surface, a brush means 26 is preferably engaged on a portion of the curved terminal edge 22, as seen in FIGS. 5 and 6, to further aid in the effective scooping and scrubbing of the sink surface.

Preferably, the device includes a handle or finger gripping means 30 providing a gripping edge 30A having an inverted U-shape, that allows the device to be easily grasped and manually manipulated while scrubbing, stuffing, and stoppering. There are numerous embodiments of such a finger gripping means 30 that may be successfully incorporated within the scope and spirit of the appended claims. In one preferred embodiment, illustrated in FIGS. 1, 3 and 5, the finger gripping means 30 extends upwardly from the disk-shaped body 10, but does not extend beyond an upper, upfacing surface 12 of the body 10. This provides for a low profile within the sink drain. In another embodiment, illustrated in FIGS. 2, 4 and 6, the finger gripping means 30 is attached to and extends upwardly from the upfacing surface 12 of the body 10. As best seen in FIGS. 3 and 4, the finger gripping means 30 is preferably positioned opposite the scrubbing surface 24 on the scooping means 20 so that when the first four fingers of one hand are placed in the finger gripping means 30, the curved terminal edge 21 of the scooping means 20 is easily and comfortably positioned against the sink surface. As also seen in FIGS. 3 and 4, the horizontal wall 17 of the body 15 is preferably concave so as to provide additional space in which to place the fingers.

A means for accommodating a thumb 40 is preferably included on the scooping means 20 of the device so that when the fingers of one hand are engaged with the finger gripping means 30, the thumb accommodating means 40 is positioned to naturally accept a thumb of the same hand as the fingers (not shown). There are numerous possible embodiments of the thumb accommodating means 40 that may be successfully incorporated within the present invention. In one preferred embodiment, illustrated in FIGS. 5 and 6, the thumb accommodating means 40 is formed integrally with the terminal curved edge 22 of the scooping means 20 and consists of an upwardly extending curved cutout in the scooping means 20.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination sink stoppering, surface scrubbing and garbage stuffing device comprising, a generally horizontally oriented disk-shaped body, the body providing an annular, down facing means for surface sealing; and a curved downwardly extending means for garbage scooping, the scooping means providing a cylinder-like sidewall, one portion of the sidewall extending continuously in an arc extending approximately halfway around the sidewall, the opposing side of the portion being open for accepting garbage, the scooping means being positionable for contacting a sink surface requiring scrubbing, and positionable in a drain for pushing garbage therethrough.

2. The combination of claim 1 wherein the surface sealing means includes a protruding rim extending annually outwardly from an annular wall having an S-shaped cross-section.

3. The combination of claim 1 wherein the surface sealing means includes a flat flange terminating with an annular, downwardly protruding stiffening rim.

4. The combination of claim 1 further including a means for finger gripping of the combination the gripping means providing a gripping edge having an inverted U-shape.

5. The combination of claim 4 further including a means for accommodating a thumb, the accommodating means being a thumb sized curved cutout in the side wall, the cutout formed integrally with the curved edge of the scooping means, said cutout positioned such that with the fingers of one hand engaged with the means for finger gripping, the thumb accommodating means is positioned to naturally accept the corresponding thumb.

6. The combination of claim 4 wherein the disk-shaped body includes an upper, upfacing surface, the finger gripping means extending upwardly no further than the up-facing surface.

7. The combination of claim 1 further including a scouring pad scrubbing surface engaged on the means for scooping.

8. The combination of claim 1 further including a brush means engaged on the means for scooping.

9. The combination of claim 8 wherein the brush means is engaged on the curved edge of the means for scooping.

* * * * *